US007437088B2

(12) United States Patent
Shida

(10) Patent No.: US 7,437,088 B2
(45) Date of Patent: Oct. 14, 2008

(54) IMAGE FORMING APPARATUS INCLUDING FIRST AND SECOND CLEANING MEMBERS WITH APPLIED VOLTAGES BASED ON RECORDING MATERIAL TYPE

(75) Inventor: Masanori Shida, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/855,398

(22) Filed: Sep. 14, 2007

(65) Prior Publication Data

US 2008/0013979 A1 Jan. 17, 2008

Related U.S. Application Data

(62) Division of application No. 11/241,983, filed on Oct. 4, 2005, now Pat. No. 7,313,335.

(30) Foreign Application Priority Data

Oct. 19, 2004 (JP) ..... 2004-304968

(51) Int. Cl.
*G03G 15/00* (2006.01)

(52) U.S. Cl. ..... 399/45; 399/71; 399/354

(58) Field of Classification Search ..... 399/45, 399/71, 354
See application file for complete search history.

(56) References Cited

U.S. PATENT DOCUMENTS 4,533,236 A 8/1985 Garsin

FOREIGN PATENT DOCUMENTS

| | | |
|---|---|---|
| JP | 2-14326 | 6/1990 |
| JP | 4-27988 | 1/1992 |
| JP | 4-178680 | 6/1992 |
| JP | 4-251276 | 9/1992 |
| JP | 2002-207403 | 7/2002 |
| JP | 2003-57885 | 2/2003 |
| JP | 2003-66735 | 3/2003 |
| JP | 2003-215879 | 7/2003 |
| JP | 2003280456 A * | 10/2003 |

* cited by examiner

*Primary Examiner*—Susan S Lee
(74) *Attorney, Agent, or Firm*—Fitzpatrick, Cella, Harper & Scinto

(57) ABSTRACT

An image forming apparatus having an image bearing member rotatable and bearing a toner image thereon, a transferring apparatus for electrostatically transferring the toner image born on the image bearing member to a recording material, a cleaning apparatus for electrostatically removing any toner not transferred to the recording material by the transferring apparatus but residual on the image bearing member from the image bearing member, a bias applying apparatus for applying a bias to the cleaning apparatus, and a controlling apparatus for variably controlling the bias condition of the bias applied to the cleaning apparatus by the bias applying apparatus, in accordance with the type of the recording material.

1 Claim, 7 Drawing Sheets

IMAGE FORMING APPARATUS INCLUDING FIRST AND SECOND CLEANING MEMBERS WITH APPLIED VOLTAGES BASED ON RECORDING MATERIAL TYPE

CROSS-REFERENCE TO RELATED APPLICATION

This application is a divisional application of application Ser. No. 11/241,983,filed Oct. 4, 2005.

BACKGROUND OF THE INVENTION

1. Field of the Invention

The invention relates to an image forming apparatus using an electrophotographic printing method or an electrostatic recording method such as, for example, copying machine, a printer or a facsimile apparatus, and particularly to an image forming apparatus adapted to form a visible image, i.e., a developed image (toner image), on an image bearing member by the electrophotographic printing method, the electrostatic recording method or the like, and transfer the toner image to a recording material through an intermediate transfer member.

2. Related Background Art

In recent years, as a plural-color or full-color image forming apparatus adopting an electrostatic process such as the electrophotographic printing method or the electrostatic recording method, there has been proposed an image forming apparatus of a so-called intermediate transfer type which successively superposes toner images of respective colors formed on a photosensitive drum which is an image bearing member on an intermediate transfer member to thereby form a color image, and collectively transfers the color image to a recording material.

In this intermediate transfer type, a toner image is formed on the photosensitive drum by charging means, exposing means and developing means disposed around the photosensitive drum, and in a primary transferring portion, the toner image is electrostatically transferred to an intermediate transfer belt as the intermediate transfer member by transferring means. When a color image is to be formed, toner images are successively transferred to the intermediate transfer belt, whereby a full-color image can be formed on the intermediate transfer belt (image bearing member).

The toner images transferred to the intermediate transfer belt are conveyed to a secondary transferring portion by the rotation of the intermediate transfer belt, and are electrostatically transferred to a recording material. As a method of removing any toners not transferred to the recording material at this time, but residual on the intermediate transfer belt, there has been proposed a method of pushing a cleaning blade against the intermediate transfer belt to thereby remove the residual toners, or a method of applying a bias to fur brush cleaning means to thereby electrostatically remove the residual toners.

The fur brush cleaning is advantageous to such a problem as the influence upon the life of the intermediate transfer belt which poses a problem in blade cleaning means or a load fluctuation due to the fluctuation of frictional resistance, but the untransferred toners after the secondary transfer include toners charged to the plus (+) polarity and toners charged to the minus (−) polarity, by a secondary transfer bias, and therefore there arises the problem that all of the untransferred toners cannot be collected by a single fur brush and by the application of a bias of one polarity.

Against this problem, Japanese Patent Application Laid-open No. 2002-207403 discloses a method of applying a plus (+) bias and a minus (−) bias differing in polarity to a plurality of fur brushes (cleaning means) from a power supply (bias applying means) to thereby collect the untransferred toners after the secondary transfer.

Also, as the control of an electrostatic cleaning type, as described in Japanese Patent Application Laid-open No. H4-178680, there has been proposed a method of controlling a bias voltage applied to cleaning means depending on the ambient environmental condition.

Further, Japanese Patent Application Laid-open No. H4-251276 proposes a method of controlling a transfer bias applied to transferring means depending on the impedance of a recording material in a secondary transferring portion.

In the above-described image forming apparatus, however, there has arisen the problem that depending on the types of the recording material, the states of the toners not transferred to the recording material but residual on the intermediate transfer member differ, and suitable cleaning of the intermediate transfer member is not done.

That is, the methods described in the Japanese Patent Application Laid-open No. H4-251276 alleviate the unevenness of a cleaning property due to the environment, but even in the same environment, depending on the types of the recording material, unevenness occurs to the amount of untransferred toner to be removed, and this may sometimes cause the problem of unfaulty cleaning. Particularly, an embossed recording material greatly differs in the amount of untransferred toner depending on the irregularity (indentation and salient) of the surface thereof, and in one cycle of image formation, and in the longitudinal direction of the belt, there are mixedly present portions great in the amount of untransferred toner and portions small in the amount of untransferred toner, and this is liable to cause faulty cleaning in the portions great in the amount of untransferred toner.

Also, according to the method described in the Japanese Patent Application Laid-open No. H4-251276, the transfer bias can be controlled by the impedance of the recording material, but as described above, even during one cycle of secondary transfer, the close contact property in the secondary transferring portion differs depending on the salient and indentation of the surface of the recording material and therefore, a proper transfer bias conforming to the indentation and salient of the paper cannot be selected.

FIG. 8 of the accompanying drawings is a graph showing the density of image relative to the transfer voltages in an indentation and a salient when a solid image has been transferred to embossed paper.

As shown in FIG. 8, on the embossed paper, between the indentation and the salient, a difference occurs to transfer pressure in a secondary transferring nip (secondary transferring portion) and therefore, the transfer characteristic differs. Further, in the indentation, a minute clearance occurs in some cases, and this leads to the occurrence of a case where the transfer efficiency itself becomes low. Therefore, if the transfer voltage is adjusted to the transfer property of the salient, the amount of untransferred toner residual on the transfer belt will become great in the indentation. If conversely, the transfer voltage is adjusted to the transfer property of the indentation, the amount of untransferred toner residual on the transfer belt will become great in the salient.

In contrast, in the electrostatic fur brush cleaning, when for example, the charging polarity of the toner is minus (−), the toner collecting capability can be raised by making the bias applied to the fur brush opposite, i.e. plus (+) in polarity to the toner, and increasing the intensity of the bias, but if the bias continues to be applied with its intensity increased, the toner deposited in the fur brush will be charged to the plus (;) polarity by charge injection or discharge, and there will arise the problem that the once collected toner is discharged onto the intermediate transfer belt. The toner thus discharged onto the belt is transferred to the recording material during the next image formation and causes a faulty image.

Therefore, the lower limit value of the bias setting of the electrostatic fur brush cleaning is set to bias intensity which can collect the untransferred toner, and the upper limit value thereof is set to bias intensity at which it is difficult for the toner to be reversed during collection. As the result, an upper limit is formed in the collecting capability by the upper limit value of the bias intensity.

FIG. 9 of the accompanying drawings is a graph showing the relation between the amount of secondary-transferring residual toner and the electrostatic cleaning bias. An area A in FIG. 9 is an area in which the slipping-out of the toner occurs because an amount of secondary-transferring residual toner exceeding the cleaning capability is carried to this area, and an area B is an area in which the bias intensity is too high and the toner deposited in the fur brush begins to be discharged onto the intermediate transfer belt.

That is, when an attempt is made to prevent the discharge, the amount of secondary-transferring residual toner X $mg/cm^2$ in FIG. 9 assumes the upper limit value of fur brush cleaning.

However, in a case where the amount of secondary-transferring residual toner in the indentation of the embossed paper is X $mg/cm^2$ or greater, the slipping-out of the toner will occur unless the bias applied from a power supply (bias applying means) to the fur brush (cleaning means) is Vtr1 or greater. Consequently, the bias applied to the fur brush must be set to a bias of Vtr1 or greater.

As the result, in order to remove the untransferred toner in the indentation of the embossed paper, the cleaning bias must be made Vtr1 or greater even for other recording materials than the embossed paper in which the amount of secondary-transferring residual toner is less than X $mg/cm^2$, and there arises the problem that the reversal of the charging polarity of the toner begins and the toner once collected by the fur brush is discharged onto the intermediate transfer belt.

SUMMARY OF THE INVENTION

It is an object of the present invention to provide an image forming apparatus in which it is possible to effect the suitable cleaning of an image bearing member irrespective of the type of a recording material.

It is another object of the present invention to provide an image forming apparatus having:

an image bearing member rotatable and bearing a toner image thereon;

transferring means for giving charge to the toner image and transferring the toner image borne on the image bearing member to a recording material;

cleaning means to which a bias is applied and which electrostatically removes toner to which charge is given by the transferring means and remaining on the image bearing member from the image bearing member;

bias applying means for applying the bias to the cleaning means; and controlling means for variably controlling the bias condition of the bias applied to the cleaning means by the bias applying means in accordance with the type of the recording material.

BRIEF DESCRIPTION OF THE DRAWINGS

FIG. 5 is a graph showing the relation between a transfer voltage and transfer efficiency in the secondary transferring portion.

DESCRIPTION OF THE PREFERRED EMBODIMENTS

The present invention has solved the above-noted problems by providing controlling means for variably controlling the bias condition of a bias applied to cleaning means by bias applying means, in accordance with the type of a recording material.

That is, the charged state of a toner not transferred to the recording material but residual on an image bearing member is varied by the type of the recording material. By providing the controlling means for variably controlling the bias condition in accordance with the type of the recording material, it is possible to effect cleaning under a bias condition suited for the charged state of the residual toner.

In this manner, the above-noted problems have been solved.

An image forming apparatus according to the present invention will hereinafter be described in greater detail with reference to the drawings.

Embodiments described below are some examples of the best embodiment of the present invention, but the present invention is not restricted to these embodiments.

Embodiment 1

Figure 1:
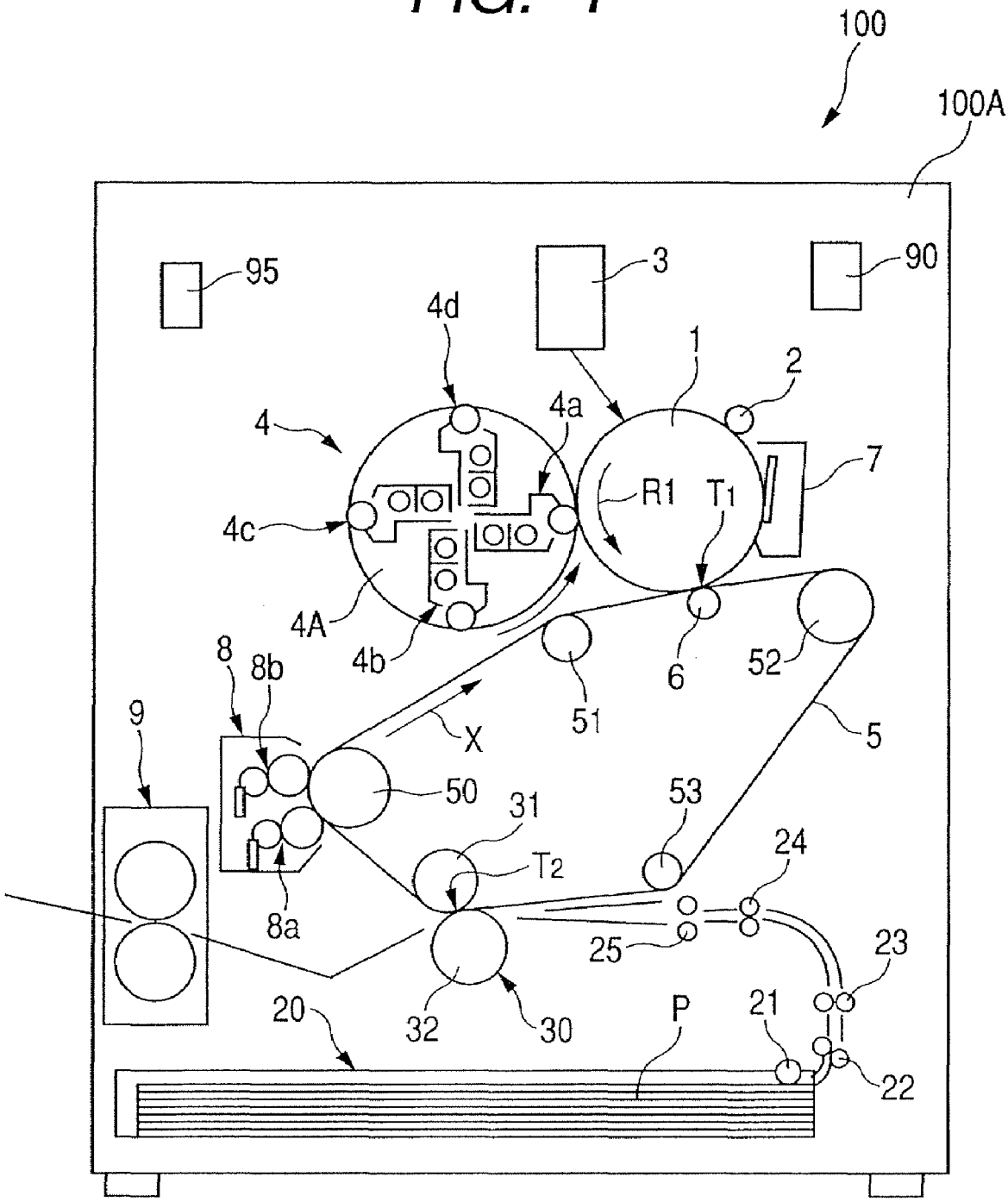
FIG. 1 is a cross-sectional view schematically showing the construction of an embodiment of the image forming apparatus of the present invention.

FIG. 1 schematically shows the construction of an embodiment of the image forming apparatus according to the present invention. In the present embodiment, the image forming apparatus 100 is an electrophotographic image forming apparatus using an intermediate transfer member.

In the present embodiment, in an image forming apparatus main body 100A, there is disposed an endless intermediate transfer member (image bearing member), i.e. intermediate transfer belt 5, stretched around supporting rollers 50, 51, 52, 53 and 31 and movable in the direction indicated by the arrow X.

This intermediate transfer belt 5 is formed of dielectric material resin such as polycarbonate, polyethylene terephthalate resin film, polyvinylidene fluoride resin film, polyimide or ethylene tetrafluoroethylene copolymer.

While in the present embodiment, there is adopted an electrically conductive polyimide seamless belt having volume resistivity of $1\times10^{9}\Omega\cdot$cm (measured by the use of a probe based upon JIS-K6911 law, an applied voltage of 500 V and application time of 60 sec.), and a thickness of 80 μm, use may be made of a belt of other material having other volume resistivity and thickness.

Also, in some cases, the intermediate transfer belt 5 having an elastic layer as the surface layer thereof cannot adopt blade cleaning as cleaning means therefor, but in the present embodiment, as will be described later, electrostatic type fur brush cleaning means is used as the cleaning means and therefore, it can be suitably used.

A recording material P taken out of a sheet supply cassette 20 is fed to a secondary transferring portion T2 having a secondary transfer roller 32 as secondary transferring means disposed therein, by conveying rollers 22-25 via a pickup roller 21. The secondary transfer roller 32 is disposed in opposed relationship with the above-mentioned supporting roller 31 which functions also as an opposed roller, and nips the intermediate transfer belt 5 between itself and the supporting roller 31.

Figure 2:
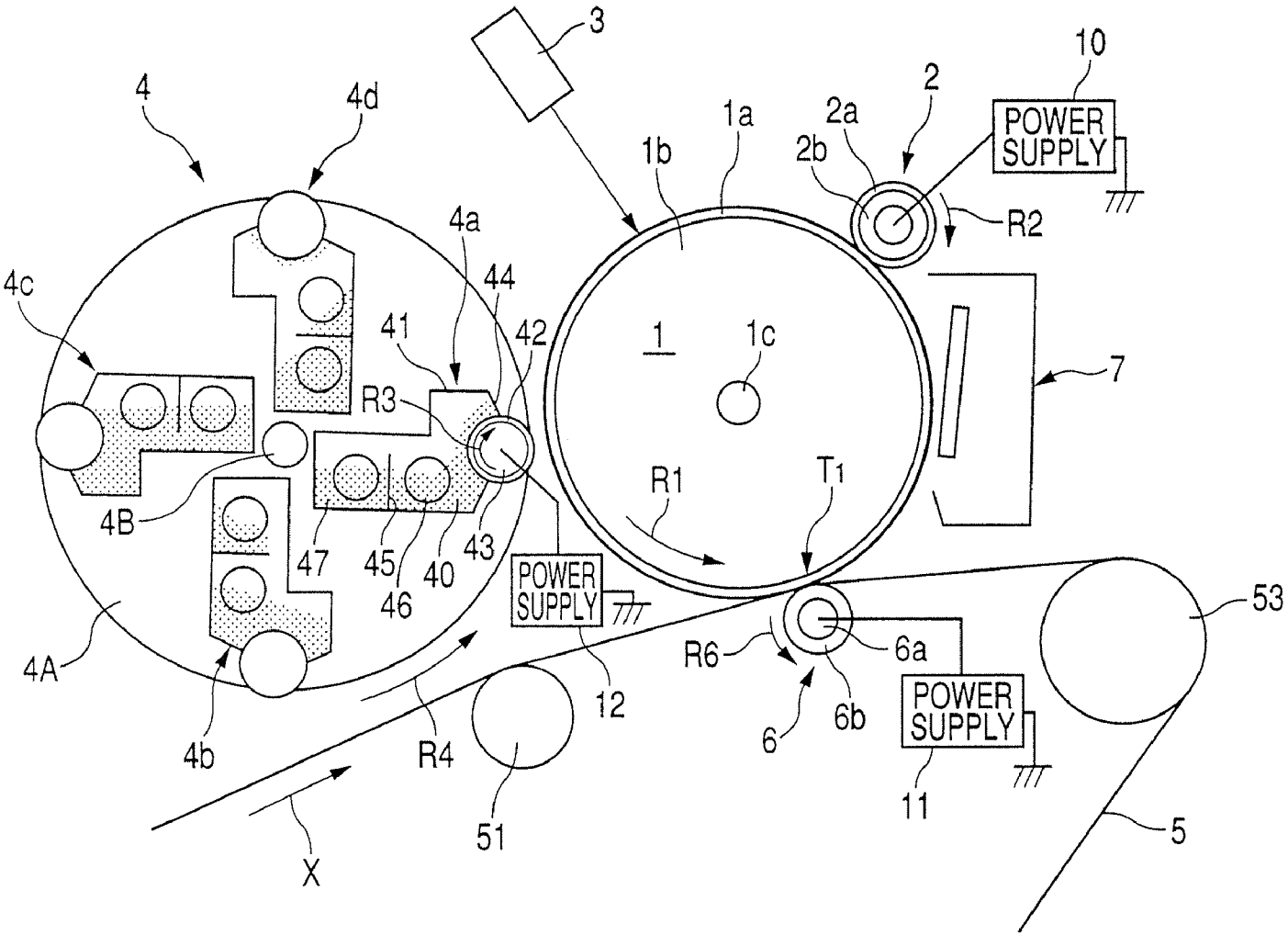
FIG. 2 shows the image forming portion of the image forming apparatus of the present invention.

An image forming portion will now be described with reference to FIG. 2.

In the present embodiment, the image forming portion is provided with a drum-shaped electrophotographic photosensitive member (hereinafter referred to as the "photosensitive drum") 1 as an image bearing member rotatably disposed. The photosensitive drum 1 is a cylindrical electrophotographic photosensitive member provided with an electrically conductive base member 1*b* of aluminum or the like, and a photoconductive layer 1*a* formed on the outer periphery of the electrically conductive base member 1*b*, as a basic construction. The photosensitive drum 1 has a supporting shaft 1*c* at its center, and is rotatively driven in the direction indicated by the arrow R1 about the supporting shaft 1*c* by driving means (not shown).

Around the photosensitive drum 1, there are provided process instruments such as a primary charger 2 as primary charging means, an exposing apparatus 3 like a laser beam scanner as exposing means, and a developing apparatus 4 as developing means.

In the present embodiment, the primary charger 2 is a charging roller constructed into a roller shape as a whole which contacts with the surface of the photosensitive drum 1 and uniformly charges the surface of the photosensitive drum 1 to a predetermined polarity and predetermined potential.

The charging roller 2 has an electrically conductive roller (mandrel) 2*b* disposed at the center thereof, and an electrically conductive layer 2*a* formed on the outer periphery thereof, and the opposite end portions of the mandrel 2*b* are rotatably supported by bearing members and the charging roller 2 is disposed in parallelism to the photosensitive drum 1. The bearing members at these opposite end portions are biased toward the photosensitive drum 1 by pressing means (not shown), whereby the charging roller 2 is brought into pressure contact with the surface of the photosensitive drum 1 with a predetermined pressure force.

The charging roller 2 is driven to rotate in the direction indicated by the arrow R2 by the rotation of the photosensitive drum 1 in the direction indicated by the arrow R1. An electrical contact connected to a power supply 10 is in contact with the mandrel 2*b* of the charging roller 2. A bias voltage is applied to the charging roller 2 by the power supply 10, whereby the surface of the photosensitive drum 1 is uniformly contact-charged. Then, an electrostatic latent image is formed on the photosensitive drum 1 by image exposure from the exposing means 3.

In the present embodiment, the developing apparatus 4 disposed downstream of the exposing means 3 is a rotary developing apparatus provided with a rotary member 4A rotated about a rotary shaft 4B. A plurality of, in the present embodiment, four developing devices 4*a*, 4*b*, 4*c* and 4*d* are carried on the rotary member 4A, and accordingly, the rotary member 4A is rotated by 90° each in the direction indicated by the arrow R4 about the rotary shaft 4B to thereby move the developing devices 4*a*, 4*b*, 4*c* and 4*d* to a position opposed to the photosensitive drum 1 (developing position) in the named order, and the electrostatic latent image formed on the photosensitive drum 1 can be developed into a developed image (toner image).

The developing devices 4*a*, 4*b*, 4*c* and 4*d* are of the same construction and therefore, the developing device 4*a* will now be described.

The developing device 4*a* has a developer container 41 containing a developer 40 therein, and a developing sleeve 42 as a developer carrying member is installed in the opening portion of the developer container 41 which faces the photosensitive drum 1, for rotation in the direction indicated by the arrow R3. In the developing sleeve 42, a magnet roller 43 for causing the developer to be carried on the developing sleeve 42 is fixedly disposed against rotation relative to the rotation of the developing sleeve 42.

Above the developing sleeve 42 in the developer container 41, there is installed a regulating blade 44 for regulating the developer carried on the developing sleeve 42 and forming it into a thin developer layer.

In the substantially lower half portion of the developer container 41, there are provided a developing chamber 46 and an agitating chamber 47 comparted by a partition wall 45.

In the present embodiment, the developer 40 is a dual-component developer composed chiefly of a toner and a carrier which is a magnetic material. The toner is negatively chargeable, and the carrier is positively chargeable.

First, the developer 40 in the developing chamber 46 is scooped up by the magnetic poles of the magnet roller 43 with the rotation of the developing sleeve 42, and is carried on the developing sleeve 42. The developer 40 is carried by the rotation of the developing sleeve 42, and in the carrying process thereto, the toner is charged to the negative and also, the developer 40 is regulated by the regulating blade 44 disposed perpendicularly to the developing sleeve 42, and is formed into a thin developer layer. The developer 40 formed into a thin developer layer, when carried to a developing area opposed to the photosensitive drum 1, the developer stands like ears of rice by the magnetic force of the developing main pole of the magnet roller 43 located in the developing area to be formed into a magnetic brush of the developer 40.

The surface of the photosensitive drum 1 is rubbed by this magnetic brush and also, a developing bias voltage is applied to the developing sleeve 42 by a bias voltage power supply 12. By the application of the developing bias, the toner adhering to the carrier constituting the ears of the magnetic brush adheres to and develops the visible portion (the exposed portion by a laser beam) of the electrostatic latent image, whereby a toner image is formed on the photosensitive drum 1.

Below the photosensitive drum 1, there is disposed a roller-shaped transferring apparatus (hereinafter referred to as the "transfer roller") 6 constituting primary transferring means.

The transfer roller 6 is constituted by an electrically conductive roller shaft 6*a* connected to a power supply 11, and an electrically conductive layer 6*b* cylindrically formed on the outer peripheral surface thereof. As the electrically conductive layer 6*b* of the transfer roller 6, it is desirable that the resistance value thereof be of the order of $10^5$-$10^8\Omega\cdot$cm, and use be made of EPDM, SBR, BR or the like having a closed cell property or an open cell property.

The transfer roller 6 has its opposite end portions biased toward the photosensitive drum 1 by pressing members (not shown) such as springs. By being biased by the pressing members, the electrically conductive layer 6*b* of the transfer roller 6 is brought into pressure contact with the photosensitive drum 1 side with a predetermined pressure force so as to nip the intermediate transfer belt 5 therebetween, and a transfer nip portion, i.e., a primary transferring portion T1, is formed.

The other developing devices 4*b*, 4*c* and 4*d* are similar in construction to the developing device 4*a*, and the difference of these developing devices 4*a*, 4*b*, 4*c* and 4*d* is that they form yellow, magenta, cyan and black toner images, respectively.

It is to be understood that a yellow toner, a magenta toner, a cyan toner and a black toner are contained in the developing devices 4*a*, 4*b*, 4*c* and 4*d*, respectively.

An image signal by the yellow component color of an original is projected onto the photosensitive drum 1 through the intermediary of a polygon mirror (not shown) or the like and an electrostatic latent image is formed, and the yellow toner is supplied thereto from the developing device 4*a*, whereby the electrostatic latent image becomes a yellow toner image. When with the rotation of the photosensitive drum 1, this toner image arrives at the primary transferring portion T1 in which the photosensitive drum 1 and the intermediate transfer belt 5 contact with each other, the yellow toner image is transferred to the intermediate transfer belt 5 by a transferring bias applied to the transfer roller 6.

The intermediate transfer belt 5 bearing the yellow toner image thereon makes one full rotation and is again conveyed to the primary transferring portion T1. By this time, the developing apparatus 4 has been rotated by 90° in the direction indicated by the arrow R4 about the rotary shaft 4B to thereby move the developing device 4*b* to the position opposed to the photosensitive drum, and by a method similar to that described above, a magenta toner image is formed on the photosensitive drum 1. This magenta toner image is transferred onto the yellow toner image on the intermediate transfer belt 5.

Likewise, a cyan toner image and a black toner image are superposed and transferred onto the aforedescribed toner images, and by this time, a recording material P taken out of the sheet supplying cassette 20 has arrived at the secondary transferring portion T2, and by a transferring bias applied to the secondary transferring means 30, the above-described toner images of the four colors are secondary-transferred onto the recording material P.

Figure 3:
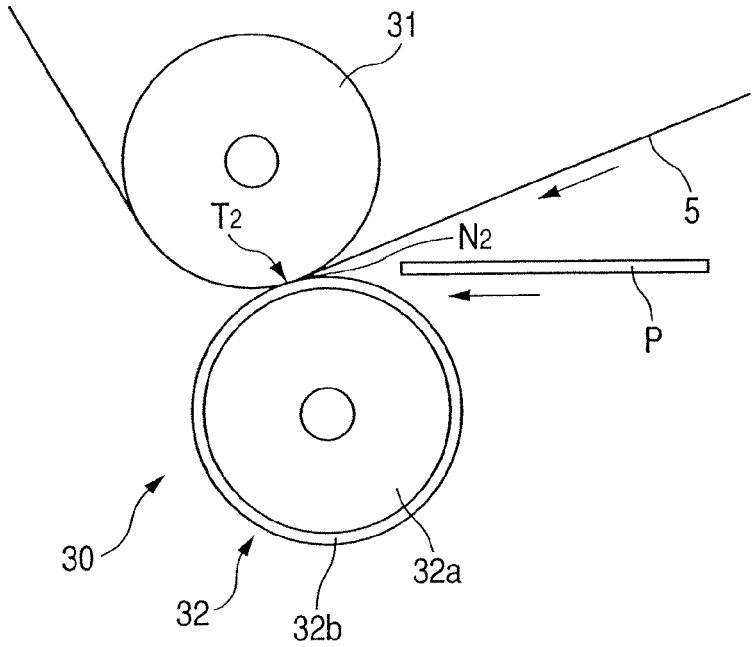
FIG. 3 shows the secondary transferring portion of the image forming apparatus of the present invention.

FIG. 3 shows the construction of the secondary transferring means 30 disposed in the secondary transferring portion T2.

The secondary transferring means (transferring means) 30 has a secondary transfer inner roller 31 which is a secondary transferring member serving as a belt extending roller located inside the intermediate transfer belt 5, and a secondary transfer outer roller 32 which is a secondary transferring member located outside the intermediate transfer belt 5.

The secondary transfer outer roller 32 is formed by an electrically conductive shaft 32*a* having a diameter of 24 mm, and an electrically conductive layer 32*b* covering the surface thereof. As the electrically conductive layer 32*b* of the secondary transfer outer roller 32, it is desirable that the resistance value thereof be $10^5$-$10^7\Omega\cdot$cm, and use be made of solid or expandable EPDM, SBR, BR or the like. The secondary transfer inner roller 31 is an electrically conductive roller, and it is desirable that the diameter thereof be 21 mm, and the material thereof be SUS, Al or the like.

A transferring bias is applied to one of the secondary transfer inner roller 31 and the secondary transfer outer roller 32 to thereby transfer the toners on the intermediate transfer belt 31 to the recording material passing through the secondary transferring portion T2, but in the present embodiment, a positive bias is applied to the secondary transfer outer roller 32 to thereby transfer the toners charged to minus (−) from the intermediate transfer belt 5 onto the recording material P.

The secondary transfer outer roller 32 is movable toward and away from the intermediate transfer belt 5, and when the yellow, magenta, cyan and black toner images are being superposed and formed on the intermediate transfer belt 5, the secondary transfer outer roller 32 is spaced apart from the intermediate transfer belt 5, and when the full-color toner image superposed on the intermediate transfer belt 5 is to be transferred to the recording material P, the secondary transfer outer roller 32 is brought into contact with the intermediate transfer belt 5.

Any residual toners not transferred to the recording material P but residual on the intermediate transfer belt 5 are carried to a cleaning portion using an intermediate transfer member cleaning apparatus 8 by the rotation of the belt 5.

Figure 4:
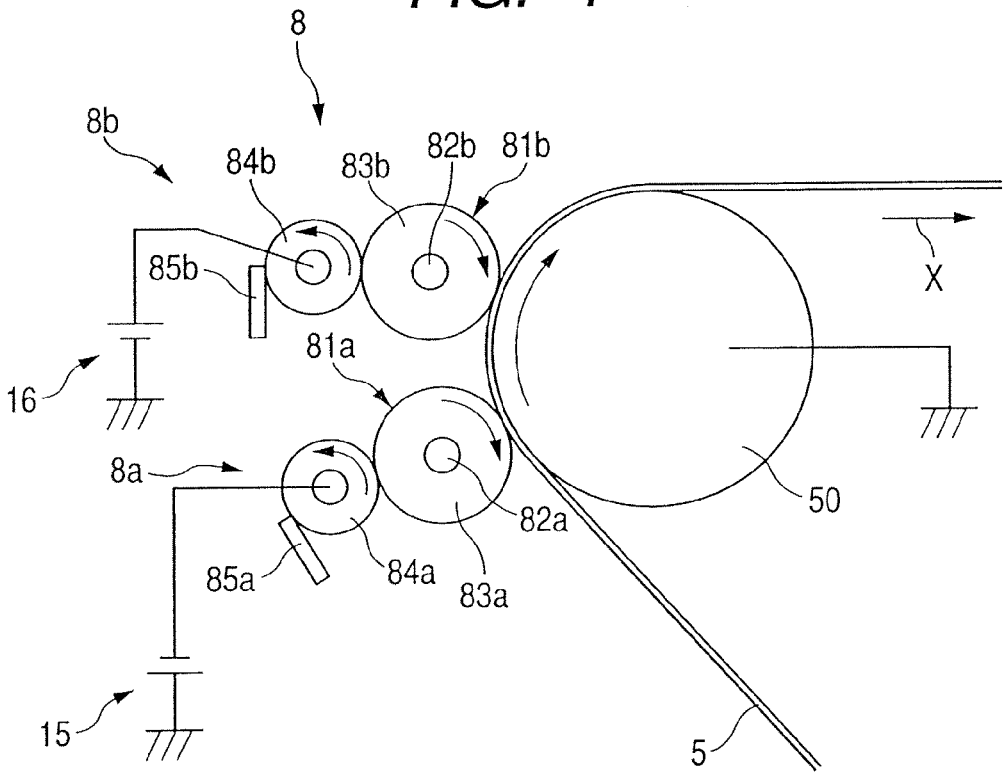
FIG. 4 schematically shows the construction of the intermediate transfer member cleaning apparatus of the image forming apparatus of the present invention.

As shown in detail in FIG. 4, in the present embodiment, the intermediate transfer member cleaning apparatus (cleaning means) 8 is disposed in opposed relationship with a stretching roller 50 supporting the intermediate transfer belt 5. The intermediate transfer member cleaning apparatus 8 is provided with a plurality of cleaning members.

In the present embodiment, it has a first cleaning apparatus 8*a* as a first cleaning member located on the upstream side with respect to the conveying direction of the intermediate transfer belt 5, and a second cleaning apparatus 8*b* as a second cleaning member located on the downstream side.

In the present embodiment, the intermediate transfer member cleaning apparatus 8 is an electrostatic type fur brush cleaning apparatus, and has a plurality of, in the present embodiment, two fur brushes 81 (81*a* and 81*b*) disposed on the upstream side and the downstream side with respect to the conveying direction of the belt.

The intermediate transfer member cleaning apparatus 8, like the secondary transfer outer roller 32, is also made movable toward and away from the intermediate transfer belt 5, and when the residual toners on the intermediate transfer belt 5 are carried to the cleaning portion of the intermediate transfer member cleaning apparatus 8, the fur brushes 81 are brought into contact with the intermediate transfer belt 5. Also, the inroad amount of the fur brushes 81 (81*a* and 81*b*) relative to the surface of the intermediate transfer belt 5 is about 1.0 mm.

The fur brushes 81 (81*a* and 81*b*) used in the present embodiment are constituted by electrically conductive shafts 82 (82*a* and 82*b*) having a diameter of 8 mm, and electrically conductive fiber-like hairs 83 (83*a* and 83*b*) implanted thereon. The material of the hairs 83 is nylon having an outer diameter of 20 mm, a pile length of 6 mm, density of 100 kF and resistance of $5\times10^6\Omega$.

Downstream of points at which the fur brushes 81 (81*a* and 81*b*) contact with the belt stretching roller 50, metallic bias rollers 84 (84*a* and 84*b*) are disposed so as to inroad the fur brushes 81 (81*a* and 81*b*). The inroad amount of the fur brushes 81 (81*a* and 81*b*) relative to the surface of the bias rollers 84 at this time is about 1.0 mm.

Also, scrapers 85 (85*a* and 85*b*) are pushed against the downstream side of points at which the metallic bias rollers 84 contact with the fur brushes 81, and the toners collected by the fur brushes 81 are shifted to the metallic roller 84, and are scraped off by the scrapers 85 to thereby cause the toners to fall into a waste toner box (not shown).

As regards the rotation direction of the respective members, the fur brushes 81 (81*a* and 81*b*) are rotated in a counter direction to the movement direction of the belt, i.e., a clockwise direction as viewed in FIG. 4, at a position opposed to the intermediate transfer belt 5. Also, the bias rollers 84 (84*a* and 84*b*) are rotated in the same direction at a position opposed to the fur brushes, i.e., a counter-clockwise direction as viewed in FIG. 4.

The delivery of the toners from the intermediate transfer belt 5 to the fur brushes 81 (81*a* and 81*b*) is effected in the following manner.

In the present embodiment, during ordinary image formation, a minus (−) bias (a bias of the same polarity as the charging polarity of the toners) is applied from a power supply (a first bias power supply) 15 to the upstream bias roller 84*a* with respect to the rotation direction of the intermediate transfer belt 5. A plus (+) bias (a bias of a polarity opposite to the charging polarity of the toners) is applied from a power supply (a second bias power supply) 16 to the downstream bias roller 84*b*. In the present embodiment, −700 V is applied to the upstream bias roller 84*a* by the power supply 15, and +700 V is applied to the downstream bias roller 84*b* by the power supply 16.

There is the possibility that toners of opposite polarities, i.e., the plus (+) polarity and the minus (−) polarity, are present in the residual toners on the intermediate transfer belt 5 after the termination of the secondary transfer and therefore, design is made such that biases of different polarities are applied to the two fur brushes 81*a* and 81*b*.

Describing, for example, the downstream cleaning portion, +700 V is applied to the bias roller 84*b*, as described above. Therefore, a voltage of +600 V is induced in the fur brush 81*b*, and a potential difference occurs between it and the grounded stretching roller 50, whereby the toners on the intermediate transfer belt 5 shifts to the fur brush 81*b*. Further, the toners collected by the fur brush 81*b* is shifted to the bias roller 84*b* by the potential difference between the fur brush 81*b* and the bias roller 84*b*.

FIG. 5 is a graph showing the applied voltage to the secondary transfer roller 32 in the secondary transferring portion T2 and transfer efficiency in the present embodiment. Dotted lines (1) and (2) in this graph indicate the transfer voltages when the transfer efficiency is 90%.

Here, the transfer efficiency was obtained by transfer efficiency=toner amount transferred to the recording material/toner amount on the intermediate transfer member before transfer×100 (%).

The voltages corresponding to the dotted lines (1) and (2) differ in voltage value from each other, namely, are 1.5 kV and 3.5 kV, but much of the residual toners on the intermediate transfer member when the transfer voltage is set to 1.5 kV is chiefly of the minus (−) polarity, and when the transfer voltage is 3.5 kV, the toners chiefly of the plus (+) polarity remain much.

This occurs because when the transfer voltage is set to 1.5 kV, the transfer voltage is deficient relative to the charges of the transferred toners, and when the transfer voltage is set to 3.5 kV, the transfer voltage is too high, whereby the polarity of the charges of the toners is reversed by the jumping-in of the charges due to the injection of the charges into the toners on the discharge.

By the reason set forth above, in the present embodiment, the two fur brushes 81*a* and 81*b* are disposed in the intermediate transfer member cleaning apparatus 8, and design is made such that biases of different polarities are applied to the fur brushes 81*a* and 81*b*.

In the image forming apparatus of the above-described construction according to the present embodiment, particularly when an image is to be transferred to embossed recording paper P, there is a case where the amount of untransferred toner not transferred but residual on the intermediate transfer belt 5 differs correspondingly to the unevenness of the surface of the recording paper, in one cycle of image formation and further, in the longitudinal direction of the secondary transferring portion T2, i.e., the transferring nip N2.

Accordingly, the present embodiment is characterized in that the bias voltage applied to the fur brushes 81 (81*a* and 81*b*) is increased only when a recording material P having unevenness on the surface thereof such as embossed paper is selected as transfer paper.

That is, controlling means 90 controls the bias voltages applied to the bias rollers 84*a* and 84*b* as follows, in accordance with the type of the recording material used.

In the case of plain paper, −700 V is applied to the bias roller 84*a* and +700 V is applied to the bias roller 84*b*, and in the case of embossed paper, −900 V is applied to the bias roller 84*a* and +900 V is applied to the bias roller 84*b*.

As described above, when use is made of the embossed paper of which the surface is rougher and the smoothness is smaller than those of the plain paper, the controlling means controls so that the absolute values of the voltages applied to the bias rollers 84*a* and 84*b* may become greater.

The surface property of paper such as the embossed paper is prescribed by smoothness and particularly, as a result of measurement effected by Bekk smoothness of JIS standard, regarding one of 10 seconds or less, and further 5 seconds or less, from the bad close contact property particularly in the secondary transferring portion T2, there arose the problem that the amount of untransferred toner corresponding to the indentation becomes great.

However, the relation between the smoothness of the recording paper P and the close contact property in the secondary transferring portion T2 differs due to the transfer pressure in the secondary transferring portion, the hardness of the transfer roller 32, the transfer characteristic of the toner, the material of the intermediate transfer belt 5, etc. and therefore, is not particularly prescribed.

In the present embodiment, the selection of the recording paper P is done before the start of copying by a user. The selection range of the recording paper P by the user covers chiefly such recording paper as plain paper/recycled paper/thick paper (several types)/OHP/label paper and further, embossed recording paper can be selected as special paper.

Figure 10:
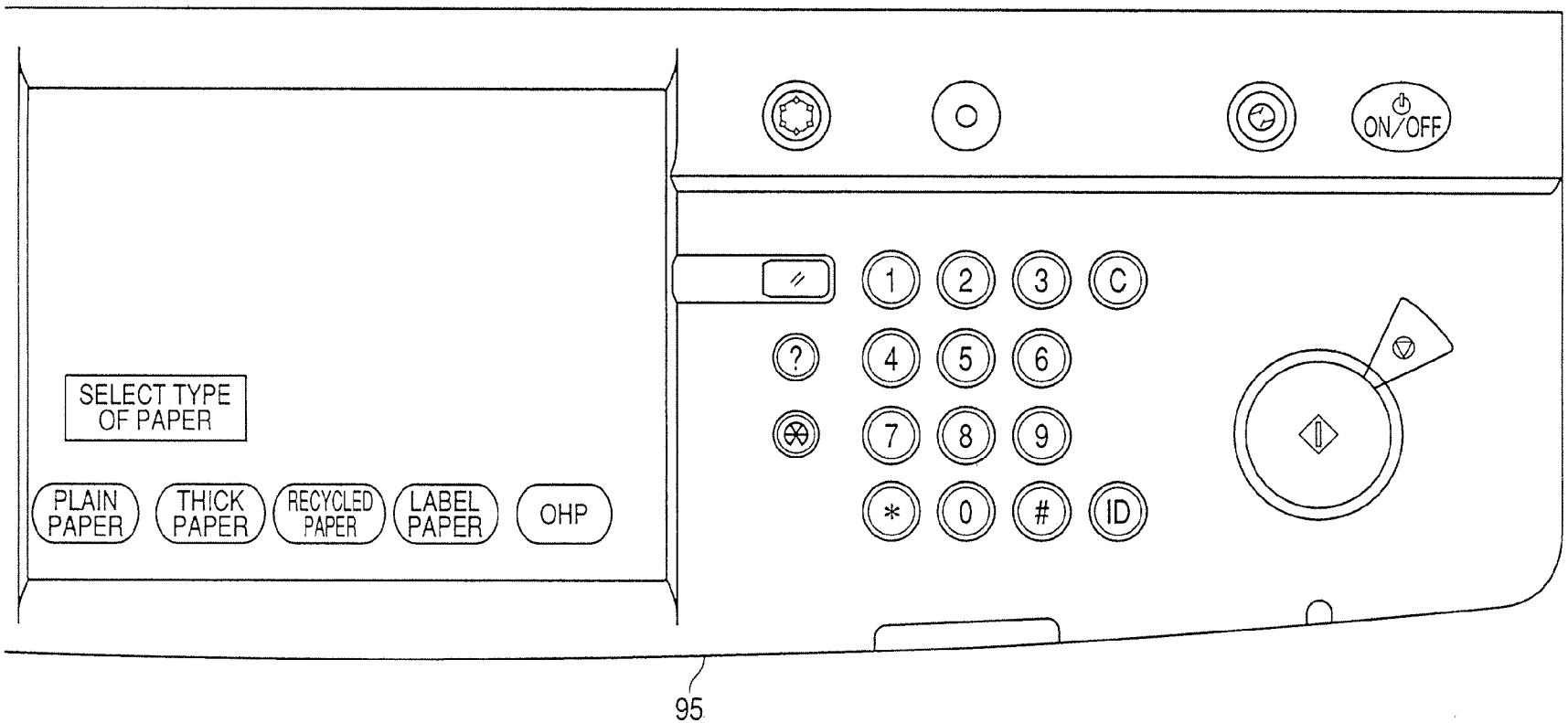
FIG. 10 represents an operating panel in the embodiment of the present invention.

The user can select the types of recording paper used, by an operating panel (recording material selecting means) 95 shown in FIG. 10.

Next, a secondary transferring bias and an intermediate transfer belt fur brush cleaning bias are selected in accordance with the selected recording paper.

Figure 6:
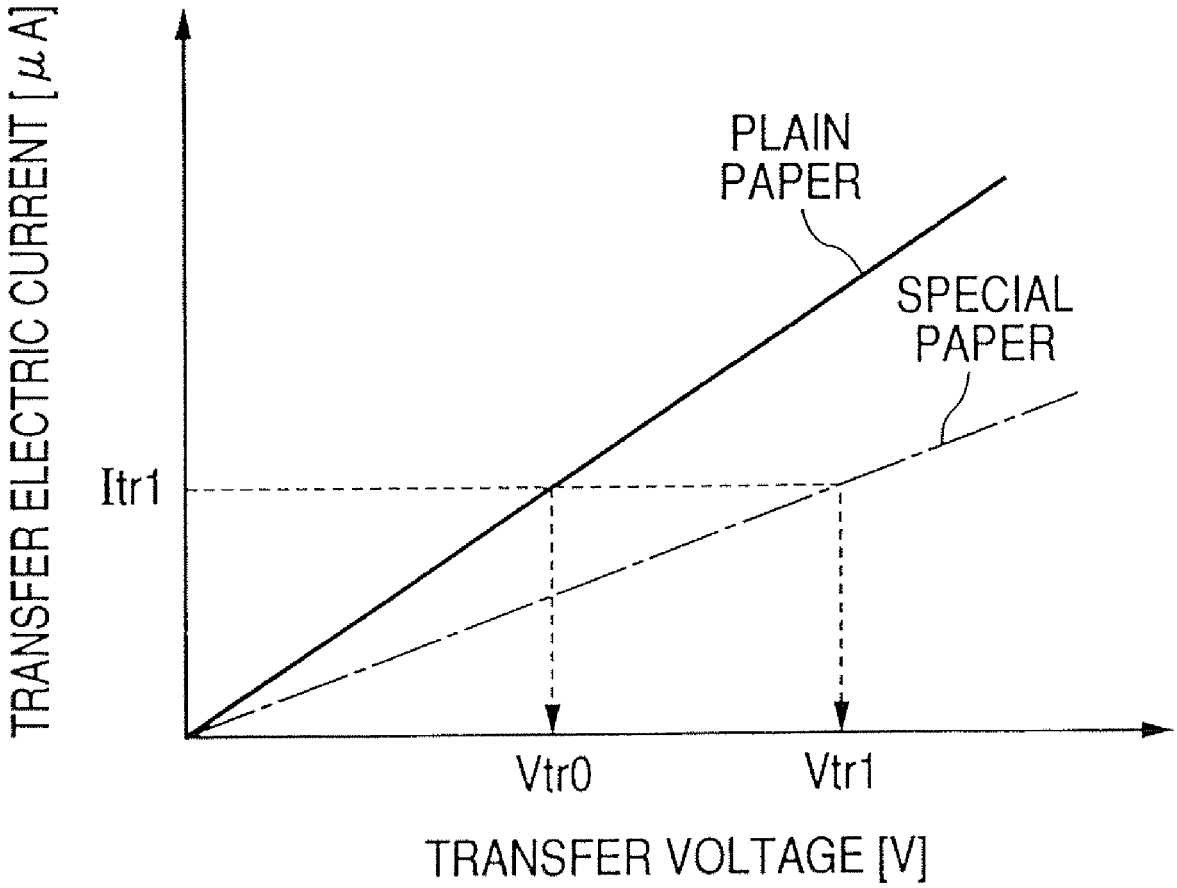
FIG. 6 shows the voltage-current characteristic of the secondary transferring portion.

FIG. 6 is a graph showing an applied voltage-electric current characteristic in the secondary transferring portion when plain paper and special paper (embossed paper) have been passed. It can be seen from the graph that the voltage-current characteristic differs depending on the resistance of the recording paper.

Here, assuming that a transfer electric current necessary for the secondary transfer is Itr1, in the case of plain paper, Vtr0 is selected, and in the case of special paper (embossed paper), Vtr1 is selected.

As the secondary transfer bias is selected, so a bias value applied to the cleaning fur brush 81 of the intermediate transfer belt 5 is selected.

Figure 7:
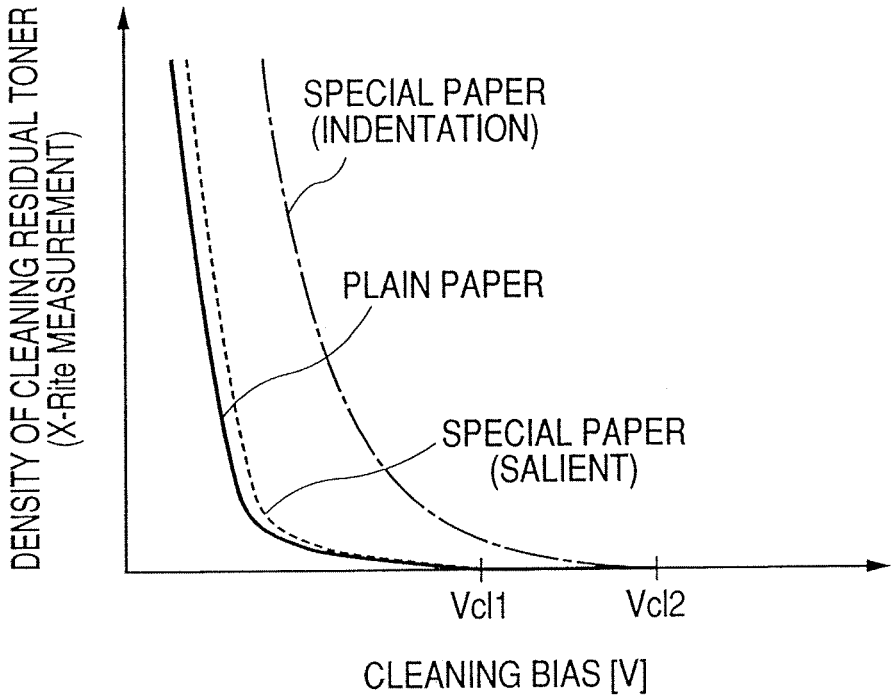
FIG. 7 shows the relation between a bias applied to the cleaning means and the density of a cleaning residual toner in the present embodiment.

FIG. 7 is a graph showing the relation between the cleaning bias and the density of the cleaning residual toner, i.e., the density of the toner passed through the cleaning portion, but yet residual on the intermediate transfer belt 5 without being capable of being removed. Curves in FIG. 7 are curves indicating the density of the cleaning residual toner when the value of the intermediate transfer belt fur brush cleaning bias has been changed relative to the secondary transfer residual toner on plain paper, the secondary transfer residual toner on the salient of special paper (embossed paper) and the secondary transfer residual toner on the indentation of the special paper.

From the graph of FIG. 7, it follows that in the case of the secondary transfer residual toner on the salient of the special paper (embossed paper), cleaning is possible by setting the intermediate transfer belt fur brush cleaning bias to Vc11, but the cleaning residual toner remains in the indentation and therefore, the intermediate transfer belt fur brush cleaning bias is set to Vc12.

However, as described in "Related Background Art" above, if the cleaning bias continues to be continuously applied with the intensity of the bias raised from Vc11 to Vc12, there will arise the problem that the charging polarity of the toners deposited in the fur brushes 81 changes and the once collected toners are discharged onto the intermediate transfer belt 5.

The reversal phenomenon of the deposited toners in the fur brushes 81 becomes more actualized by the intensity of the cleaning bias being heightened, and in FIG. 7, the cleaning bias is set to a voltage of Vc12 or greater, whereby reversed toners begin to be produced, and the amount of reversed toners increases in accordance with the intensity of the bias.

Figure 8:
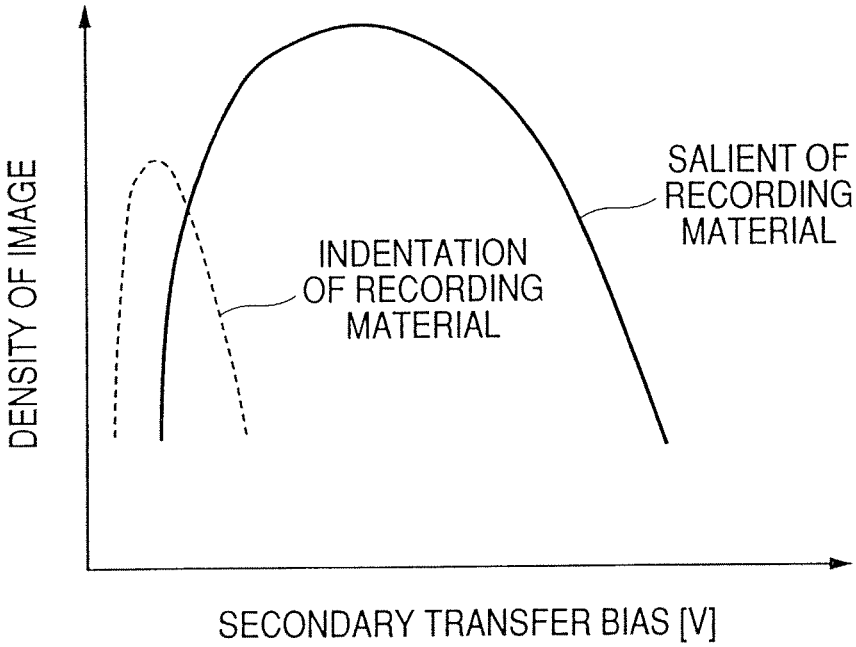
FIG. 8 shows the transferring property of the indentation and salient of embossed paper in a conventional example.
Figure 9:
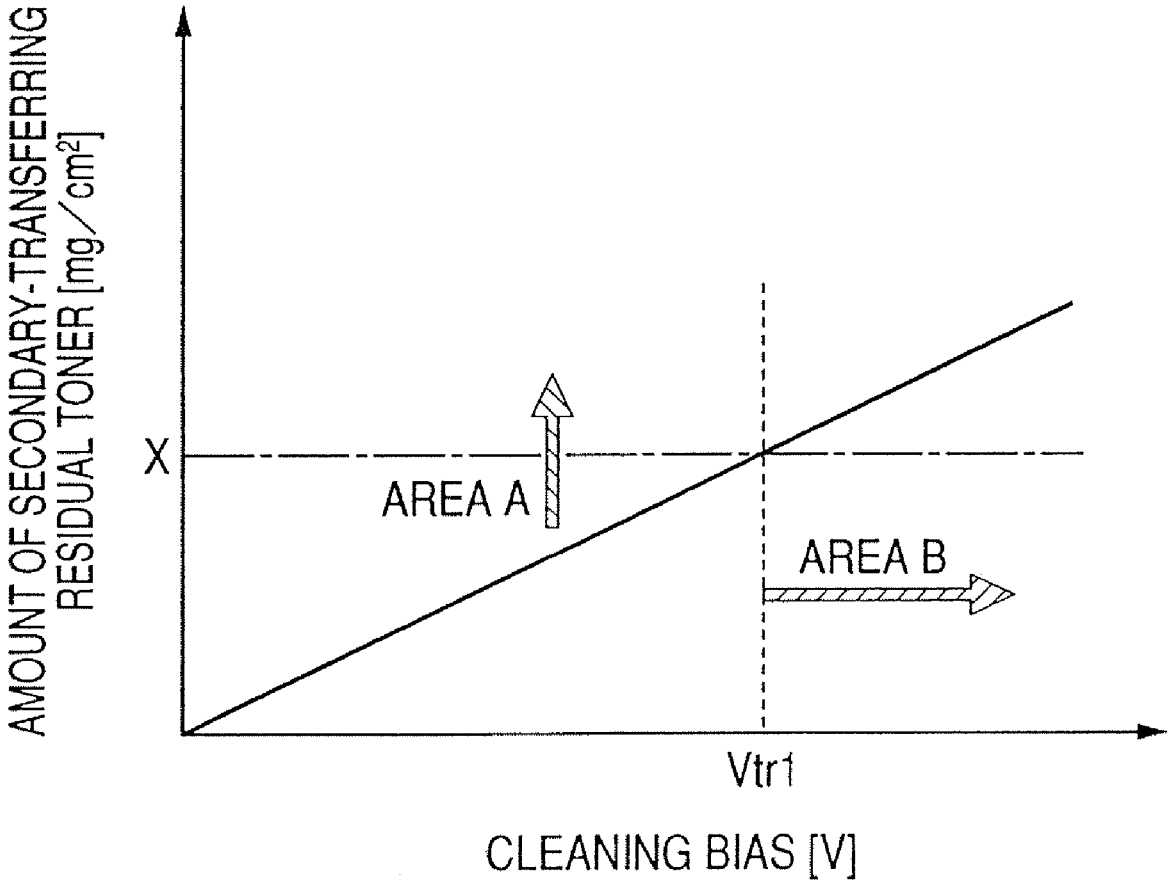
FIG. 9 shows the relation between a cleaning bias and the amount of secondary-transferring residual toner in the conventional example.

Accordingly, only when the special paper (embossed paper) is selected, the bias value is changed and the application time of a high cleaning bias is minimized, whereby the amount of reversed toner production can be minimized. Further, even if the cleaning bias values applied to the upstream and downstream fur brushes are raised, whereby the transfer voltage in FIG. 8 is set to the indentation side of the recording material, or is set to the salient side of the recording material, the intermediate transfer belt can be cleaned.

By the above-described control, it is possible to set a proper secondary transfer voltage for the plain paper, set a cleaning bias Vc11 for the residual toner amount on the intermediate transfer belt, set a proper secondary transfer voltage for the special paper (embossed paper), and set a cleaning bias Vc12 for the residual toner amount on the intermediate transfer belt, and even if the untransferred toner amount is changed by the smoothness of the recording material, the intermediate transfer belt can be cleaned by the setting of a proper cleaning bias.

While in the present embodiment, description has been made of an image forming apparatus for obtaining a full-color image, it is of course also possible to obtain a similar effect in an image forming apparatus for obtaining a black-and-white (B/W) image.

Also, the reason why in the present embodiment, the cleaning bias values, etc. are not prescribed is that they differ greatly depending on the transfer characteristic of the toners, the material and hardness of the intermediate transfer belt, the transfer pressure of the secondary transferring portion, the material and cleaning capability of the cleaning fur brushes, etc. Accordingly, the cleaning bias values are suitably selected and determined correspondingly to these conditions.

Embodiment 2

In the foregoing first embodiment, when the absolute value of the difference between the bias voltage applied to the bias roller 84*a* when the recording material is plain paper and the bias voltage applied to the bias roller 84*a* when the recording material is embossed paper is defined as Va1, and the absolute value of the difference between the bias voltage applied to the bias roller 84*b* when the recording material is plain paper and the bias voltage applied to the bias roller 84*b* when the recording material is embossed paper is defined as Vb1, Va1 and Vb1 are controlled so as to become equal to each other.

On the other hand, in a second embodiment, when the absolute value of the difference between the bias voltage applied to the bias roller 84*a* when the recording material is plain paper and the bias voltage applied to the bias roller 84*a* when the recording material is embossed paper is defined as Va2, and the absolute value of the difference between the bias voltage applied to the bias roller 84*b* when the recording material is plain paper and the bias voltage applied to the bias roller 84*b* when the recording material is embossed paper is defined as Vb2, Va2 and Vb2 are controlled so as to differ from each other.

In the present embodiment, the bias voltages applied to the bias rollers 84*a* and 84*b* when the recording material is plain paper are −700 V and +700 V, respectively. Also, the bias voltages applied to the bias rollers 84*a* and 84*b* when the recording material is embossed paper are −900 V and +800 V, respectively.

In the present embodiment, the secondary transferring bias voltages when the embossed paper is used are higher than the secondary transferring bias voltages during the use of the embossed paper in Embodiment 1.

That is, the secondary transferring bias voltage is set so as to enhance the transfer efficiency in the salient of the embossed paper. At this time, the amount of secondary transfer residual toner becomes greater in the indentation. The residual toners in the indentation are of the plus polarity due to the influence of the secondary transferring bias voltage.

Accordingly, the rate of the toners charged to the plus polarity in the residual toners is much greater than the rate of the toners charged to the minus polarity.

So, in the present embodiment, when the embossed paper is used as the recording material, control is effected so that the absolute value of the bias voltage applied to the cleaning apparatus 8*a* for collecting chiefly the residual toners charged to the plus polarity may become greater than the absolute value of the bias voltage applied to the cleaning apparatus 8*b* for collecting chiefly the residual toners charged to the minus polarity.

Now, if setting is effected as in the present embodiment, when embossed paper is continuously used, the toners reversed in polarity by the upstream fur brush 81*a* are discharged to the intermediate transfer belt 5, but become collectable by the downstream fur brush 81*b*. The downstream fur brush 81*b* is not set to such a bias voltage that the polarity of the deposited toners in the fur brush is reversed and therefore, the discharge of the toners from the downstream fur brush 81*b* does not occur, and any evil to the image by the discharged toners does not occur.

In the above-described second embodiment, even in a case where special paper (embossed paper) was used as the recording material and further, the rate of the toners charged to the plus polarity in the residual toners and the rate of the toners charged to the minus polarity in the residual toners differed greatly from each other, the biases applied to the cleaning apparatuses 8*a* and 8*b* were controlled in accordance with the polarity of the toners which occupy a greater rate in the residual toners, whereby the cleaning of the intermediate transfer belt could be suitably effected.

This application claims priority from Japanese Patent Application No. 2004-304968 filed Oct. 19, 2004, which is hereby incorporated by reference herein.

What is claimed is:

1. An image forming apparatus comprising:

an image bearing member bearing a toner image;

a transfer unit, which electrostatically transfers the toner image on the image bearing member to a recording material;

a first cleaning member to which a voltage having a predetermined polarity is applied to remove toner on the image bearing member;

a second cleaning member to which a voltage having a polarity opposite to the predetermined polarity is applied to remove toner from an area of the image bearing member from which the first cleaning member has removed the toner;

an input unit in which information on a type of the recording material is inputted; and a voltage changing unit, which changes voltages applied to the first and second cleaning members based on the information on the type of the recording material inputted in the input unit, wherein the voltage changing unit increases absolute values of the voltages applied to the first and second cleaning members as a smoothness of the recording material is decreased.

* * * * *